US010065129B2

(12) United States Patent
Hoddle

(10) Patent No.: US 10,065,129 B2
(45) Date of Patent: Sep. 4, 2018

(54) ENTERTAINMENT VENUE

(71) Applicant: C360 (I.P.) LIMITED, Hornchurch, Essex (GB)

(72) Inventor: Glenn Hoddle, Canterbury (GB)

(73) Assignee: C360 (I.P.) LIMITED, Essex (GB)

( * ) Notice: Subject to any disclaimer, the term of this patent is extended or adjusted under 35 U.S.C. 154(b) by 0 days.

(21) Appl. No.: 15/540,185

(22) PCT Filed: Nov. 24, 2015

(86) PCT No.: PCT/EP2015/077546
§ 371 (c)(1),
(2) Date: Jun. 27, 2017

(87) PCT Pub. No.: WO2016/083401
PCT Pub. Date: Jun. 2, 2016

(65) Prior Publication Data

US 2017/0326469 A1 Nov. 16, 2017

(30) Foreign Application Priority Data

Nov. 25, 2014 (GB) ..... 1420917.5

(51) Int. Cl.
*A63J 1/00* (2006.01)
*E04H 3/12* (2006.01)
(Continued)

(52) U.S. Cl.
CPC ..... *A63J 1/00* (2013.01); *E04H 3/12* (2013.01); *E04H 3/14* (2013.01); *A63J 2005/002* (2013.01); *E04H 2003/147* (2013.01)

(58) Field of Classification Search
CPC ..... A63J 1/00; A63J 2005/002; E04H 3/12; E04H 3/14; E04H 2003/147
See application file for complete search history.

(56) References Cited

U.S. PATENT DOCUMENTS 3,961,791 A * 6/1976 Etchegoyhen ..... A63F 9/14 446/136
4,611,439 A * 9/1986 Graham, Jr. ..... E04H 3/126 52/143

(Continued)

FOREIGN PATENT DOCUMENTS

WO WO 1995/05223 A1 2/1995

OTHER PUBLICATIONS

European Patent Office, International Search Report in International Application No. PCT/EP2015/077546 dated Mar. 3, 2016.

(Continued)

*Primary Examiner* — Brian E Glessner
*Assistant Examiner* — Adam G Barlow
(74) *Attorney, Agent, or Firm* — Leydig, Voit & Mayer, Ltd.

(57) ABSTRACT

An entertainment venue comprising a performance area and a spectator area surrounding the performance area, wherein the spectator area includes a static spectator portion and a dynamic spectator portion, the dynamic spectator portion including a track substrate defining a continuous loop around the performance area, a plurality of spectator pods adapted for movement around the loop relative to the track substrate; and a platform located adjacent to the track substrate, wherein each pod is spaced from and not physically connected to a neighboring pod; and each pod includes at least one proximity sensor connected to a controller, the controller being adapted to maintain a predetermined minimum spacing between adjacent pods when the pods are in motion and/or detect a foreign object located between adjacent pods.

9 Claims, 4 Drawing Sheets

(51) Int. Cl.
*E04H 3/14* (2006.01)
*A63J 5/00* (2006.01)

(56) References Cited

U.S. PATENT DOCUMENTS

| | | | | |
|---|---|---|---|---|
| 6,066,049 | A * | 5/2000 | Milanian | A63G 3/06 472/128 |
| 6,715,425 | B1 * | 4/2004 | Dore | A63K 3/00 104/53 |
| 8,347,556 | B2 * | 1/2013 | Stelmaszek | E04H 3/12 104/53 |
| 2007/0193123 | A1 * | 8/2007 | Magpuri | E04H 3/22 52/8 |
| 2010/0146869 | A1 * | 6/2010 | Stelmaszek | E04H 3/12 52/9 |

OTHER PUBLICATIONS

European Patent Office, Written Opinion in International Application No. PCT/EP2015/077546 dated Mar. 3, 2016.
International Bureau of WIPO, International Preliminary Report on Patentability in International Application No. PCT/EP2015/077546 dated May 30, 2017.

* cited by examiner

ENTERTAINMENT VENUE

CROSS-REFERENCE TO RELATED APPLICATIONS

This patent application is the U.S. national phase of International Patent Application No. PCT/EP2015/077546, filed on Nov. 24, 2015, which claims the benefit of GB Patent Application No. 1420917.5, filed Nov. 25, 2014, the disclosures of which are incorporated herein by reference in their entireties for all purposes.

The present invention relates to an entertainment venue fitted with a dynamic spectator portion which can form part of a newly constructed venue or which may be retro-fitted to an existing venue.

In entertainment venues such as stadiums, arenas, theatres and the like it is desirable to provide high value spectator areas, particularly to corporate attendees. The value of the spectator areas typically depends on the location of the area within the venue. Some locations will have a better view of the entertainment, such as a music concert or sports match, than others and for these locations the venue owner or promoter may charge higher prices. Ideally, a greater number of the locations within the venue would have an optimum view of the entertainment and therefore the highest value, but this is not possible in traditional venues. The present invention seeks to address and/or ameliorate this problem.

US2010/0146869 discloses a dynamic seating arrangement for spectator venues, such as a stadium. It describes a plurality of dynamic platforms that may move along a track or path independently or as part of a series of coupled platforms.

In accordance with a first aspect of the invention, there is provided an entertainment venue comprising a performance area and a spectator area surrounding the performance area, wherein the spectator area includes a static spectator portion and a dynamic spectator portion, the dynamic spectator portion including a track substrate defining a continuous loop around the performance area, a plurality of spectator pods adapted for movement around the loop relative to the track substrate; and a platform located radially adjacent to the track substrate, wherein each pod is spaced from and not physically connected to a neighbouring pod; and each pod includes at least one proximity sensor connected to a controller, the controllers being adapted to maintain a predetermined minimum spacing between adjacent pods when the pods are in motion and/or detect a foreign object present between adjacent pods.

The invention provides for spectators within the dynamic portion of the spectator area to enjoy different views of the performance area as the pods circulate around the loop defined by the track substrate.

In an embodiment of the invention, each pod includes a drive train comprising a power source and a motor connected to the power source. According to this embodiment, each spectator pod is individually powered and controlled, which allows for the dynamic spectator area containing different numbers of pods, depending upon the event being hosted at the entertainment venue. It also means that if a pod becomes non-functional or develops a fault, it can easily be removed without disrupting the remaining pods. It will be appreciated that where a "chain" or train of physically connected pods is provided, in which the lead pod may act as an engine for the subsequent pods, any problem associated with the lead pod has a knock-on effect on the rest of the pods in the train. Furthermore, if a pod within the train develops a fault, the train must be stopped, the faulty pod must be disconnected from the adjacent pods and the adjacent pods connected together before the train can continue.

The power source may comprise a self-contained power source in which the power source stores all of the energy needed to power the pod for the desired duration or it may comprise a power collector, e.g. a current collector, which engages a common static power source, such as an electrified cable or rail, which will enable to pod to be powered all the time the common static power source is energised.

In the aforementioned embodiment, the proximity sensors may be adapted to maintain a minimum spacing between adjacent pods and/or they may be adapted to detect a foreign object which has inadvertently become located between adjacent pods. It will be appreciated that the term "foreign object" refers to an object having a size which may interfere with the operation of the pods.

In an alternative embodiment, the pods may be located on a common drive system, for example a conveyor-type system. In this embodiment, each pod is static relative to the common drive system and the proximity sensors are present to detect a foreign object which may inadvertently become located between adjacent pods. In such a scenario, the controller may send a "stop" signal to the drive system and the movement of the pods is stopped until the foreign object can be removed safely. In this embodiment, the drive system is carried by the track substrate and the drive system moves relative to the track substrate.

In an embodiment of the invention in which the pods each include a drive train, the power source for each pod may be a rechargeable, self-contained power source. Suitably each power source is capable of storing sufficient energy to power the pod motor for the duration of the event taking place on or in the performance area. Thus, in non-event periods, the power source for each pod may be connected to an energy source, for example a mains electrical source, to charge the pod power sources and during the event periods, the pods are powered by the energy stored in their on-board power source.

The motor of each pod (where each pod includes a power train) may be controlled by an output from the controller. In this way, the speed of the motor, and thus the speed of the pod itself, may be controlled by the controller. Furthermore, the controller may have a first output or "drive" output which is adapted to drive the motor of the pod at a substantially constant speed such that the pod is driven around the loop at a substantially constant speed. Similarly, where the pods are carried by a common drive system, the first controller output may indicate to the drive system that no hazards are detected by the proximity sensors and that the drive system can continue to rotate the pods about the loop.

For any given event, the pod is suitably driven around the loop at a substantially constant predetermined speed. However, the predetermined speed may be different for different events. Thus, the predetermined speed for any given event may be selected from a plurality of different predetermined speeds.

The constant speed is suitably a speed at which spectators are able to enter and leave the pod while it is still in motion. People are familiar with moving walkways and escalators, so the concept of joining and leaving a moving object is not unusual. With the foregoing in mind, the constant speed of the pod in motion (i.e. the corresponding output from the controller) is suitably less than 6 kph (kilometres per hour). Thus, the constant speed may be less than 5 kph, less than 4 kph, less than 3 kph, or less than 2 kph. However, it is desired that each pod completes at least one circuit of the loop within the event period (i.e. the time for which the event is ongoing). Therefore, the speed is suitably greater than 0.1 kph, for example greater than 0.5 kph or greater than 0.7 kph. As an alternative parameter, the speed of the pods may be set in terms of "revolutions per unit time". For example, for a football game (i.e. soccer in the US), where each half of the game lasts for 45 minutes, the pods may have a predetermined speed of 1 revolution per 45 minutes. That is to say, each pod should complete a single complete circuit of the loop within the desired timeframe.

Although the speed of the pods may be constant during the event period, it may be necessary to stop the pods during the event if a foreign object becomes present on the track substrate in order to avoid damage to the pods, disturb the spectators present on the pods and/or damage/injure the foreign object. Thus, the controller may include a second or "emergency" output in which the motor is stopped (in embodiments in which the pods each include a drive train) or the drive system (in embodiments in which the pods are carried by a common drive system) is stopped to bring the pods to a halt until such time as the foreign object can be removed.

In a particular embodiment of the invention, each pod includes a drive train. Suitably, an output from the controller of each pod is connected to the drive train and the controller has a "drive output" which causes the pod to move at a constant speed and an "emergency" output which causes the pod to stop. Additionally, the power source for the drive train may be rechargeable, for example, a rechargeable battery system comprising one or more rechargeable cells.

The track substrate is suitably substantially planar. In addition, the loop defined by the track substrate may be provided at a single level (i.e. a single horizontal plane) around the performance area. In an embodiment of the invention, the track substrate carries at least one rail in the form of a continuous loop or it defines a path along which the pods are adapted to move. Accordingly, the track substrate may carry one or more rails which form a track upon which the pods move in use. Alternatively, the track substrate may define a path which forms a track, for example, the track substrate may define a simple planar surface, the track substrate may define one or more channels adapted to receive a guide element of each pod or it may include one or more raised side elements adapted to guide each pod. Alternatively, the track substrate defines a substantially planar surface which includes direction control elements which may be followed by a corresponding control element sensor carried by each pod. In such an embodiment, the direction control element(s) may be embedded within the track substrate or may be carried by the substrate. The direction control element(s) may be magnetic and the control element sensor carried by each pod may detect the magnetic field generated by the control element(s).

In a further embodiment, the track substrate carries a continuous moving belt or conveyor system to which each pod is secured. In this embodiment, the belt or conveyor moves relative to the track substrate and consequently, the pods move relative to the track substrate, but the pods are stationary relative to the belt or conveyor.

In a yet further embodiment, the track substrate carries an electromagnet which forms one part of a "maglev" system, with the pods each including a corresponding magnetic element adapted to levitate the pods above the track substrate via magnetic forces.

In a still yet further embodiment, the pods may move relative to the track substrate via a moving cushion of fluid, and the pods "float" upon the fluid cushion. In such an embodiment, the fluid may be a liquid, such as water, or it may be a gas, such as air. The fluid may flow around the track substrate, thereby transporting the pods around the loop, or the pods may move relative to the fluid, such as a boat, or the fluid cushion may travel with the pod, such as a hovercraft.

In embodiments in which the track substrate defines a substantially planar path, each pod may include a plurality of wheels which engage the path and permit movement of the pod relative to the path.

As an alternative to physically guiding the pods around the loop defined by the track substrate, the controller may include physical details of the track substrate and it may also include positional information relative to the pod such that the controller is able to guide the pod around the loop defined by the track substrate based on internally stored data. Thus, the controller may sense or otherwise detect (in other words, the controller "knows") where on the track the pod is located and it may be pre-programmed with directional information such that the controller is able to determine in which direction the pod needs to move in order to move around the loop.

In a particular embodiment of the invention, the track substrate defines a substantially planar surface forming a path for the pods. The path suitably defines a loop around the performance area.

The platform is provided to allow spectators to enter and leave the pods. The platform may be a circumferential platform such that the platform also forms a continuous loop, or it may be discontinuous and is adjacent to the track substrate at one or more locations about the loop. The platform may be elevationally higher or elevationally lower than the track substrate, or it may elevationally aligned with the track substrate. However, suitably, the platform is elevationally raised relative to the track substrate.

Each pod is suitably provided with an access opening to allow spectators to enter or leave the pod as appropriate. In an embodiment of the invention, the opening includes a floor portion which is elevationally aligned with the platform. As noted above, it is envisaged that the pods may move around the loop at a continuous speed for the duration of the event (possibly excluding interval periods), therefore, spectators may enter and leave the pod during the event whilst it is moving. Such action is made easier by elevationally aligning the floor portion of the access opening with the platform. Moreover, having the floor portion of the access opening elevationally level with the platform allows for wheelchair and/or pushchair access to the pod. In such an embodiment, the access opening is suitably wide enough to permit the passage therethrough of a wheelchair or similar movement aid for disabled users.

For the comfort of the spectators within the pod, it suitably includes one or more seats, which may be an individual seat for each spectator within the pod or it may be one or more communal seats upon which a plurality of spectators may sit.

In addition to seating, the pod may comprise other furniture such as tables and the like. In an embodiment of the invention each seat in the seating pod is provided with a folding table-like support surface upon which items such as food and/or drinks may be located. However, the pod may take the form of a moving room in which the spectators may move around freely. The design of the interior of each pod will depend on the spectators it is desired to accommodate.

The pods located within the dynamic portion of the spectator area may be substantially identical. Alternatively, pods of different sizes, configurations and/or seating capacity may be provided within the dynamic portion.

The skilled person will appreciate that the features described and defined in connection with the aspect of the invention and the embodiments thereof may be combined in any combination, regardless of whether the specific combination is expressly mentioned herein. Thus, all such combinations are considered to be made available to the skilled person.

BRIEF DESCRIPTION OF THE DRAWINGS

An embodiment of the invention will now be described, by way of example only, with reference to the accompanying drawings in which.

DETAILED DESCRIPTION OF THE INVENTION

Figure 1:
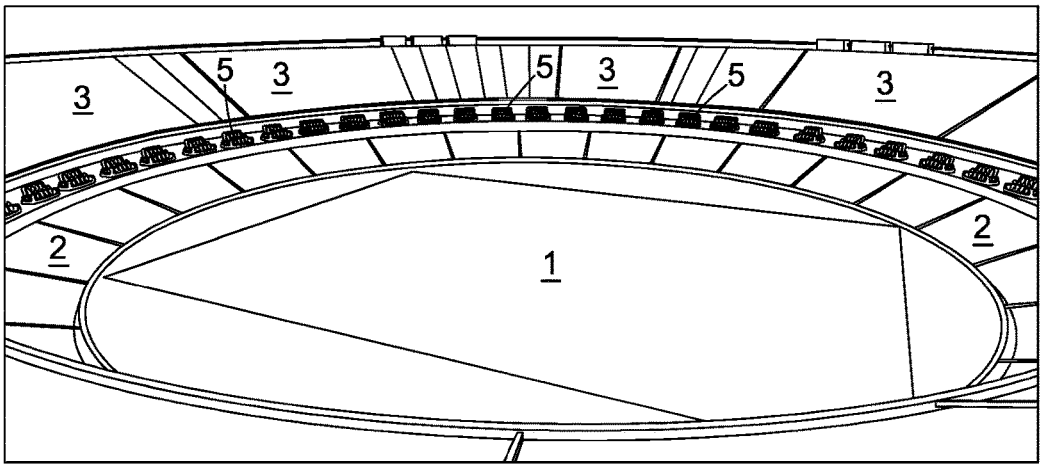
FIG. 1 is a perspective view of an entertainment venue incorporating a dynamic spectator area according to an embodiment of the present invention.
Figure 2:
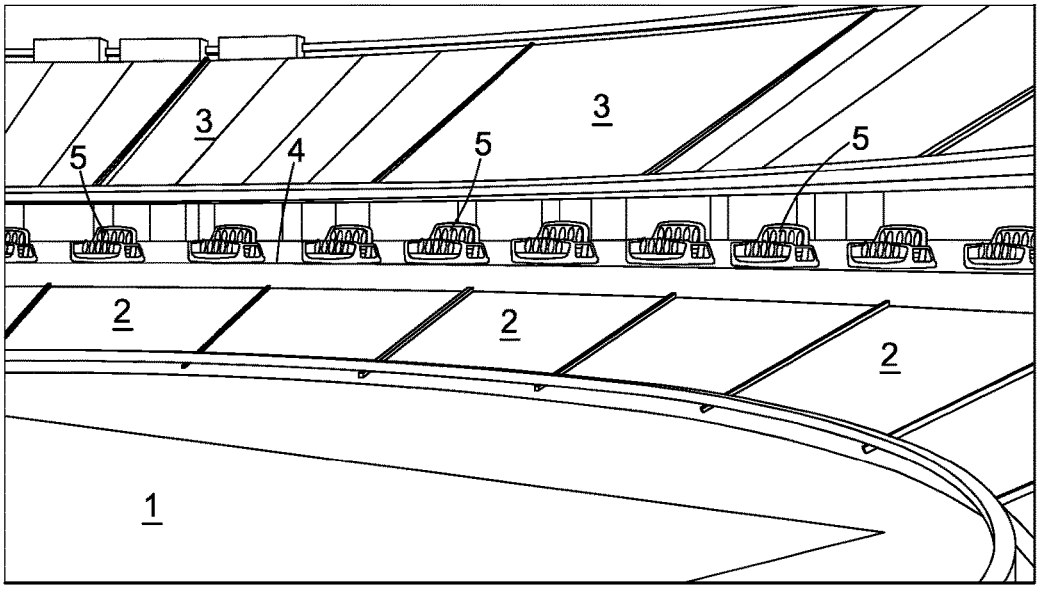
FIG. 2 is a close-up view of the entertainment venue of FIG. 1.

FIGS. 1 and 2 show an event venue incorporating a dynamic spectator area according to an embodiment of the present invention. The event venue of the present embodiment comprises a sports field 1 surrounded by a first static spectator area in the form of a lower tier 2 of fixed seating and a second static spectator area in the form of an upper tier 3 of fixed seating. Between the lower tier 2 and the upper tier 3 of static seating is provided a track substrate 4 which defines a substantially planar path in the form of a continuous loop around the sports field 1. The path carries a plurality of pods 5 in accordance with the present invention. The pods 5 are individually motorised to circulate around the stadium on the track substrate 4 so that the occupants of the pods 5 experience a continuously changing view of the sports field 1.

During an active phase of the sports event (i.e. when the game or match is in play), the pods 5 rotate around the loop defined by the track substrate 4. Where the sports field is a football (soccer) field and the track substrate 4 has a length of 800 m, it is desired that the pods each complete a single circuit of the loop in a 45 minute period (i.e. one half of the match). In this case, the pods will move at a constant speed of 800 m in 45 minutes or 1.067 kph. It will be appreciated that for longer loops, the pods will have to move relatively quicker to complete the lap within 45 minutes and for shorter loops, the pods will move at a relatively slower speed.

Each pod 5 includes wheels (not shown) on its underside and an electric motor which enable the pod 5 to travel along the path defined by the track substrate 4 under its own power. Energy for the motor is provided by a rechargeable battery arrangement (also not shown). The speed of the motor is controlled by a controller (not shown). Each pod 5 further includes a sensor located within the leading side portion (i.e. the side portion of the pod 5 which leads the pod when in motion) which maintains a minimum spacing between the pod and the adjacent pod in front of it when the pods are moving.

Figure 3:
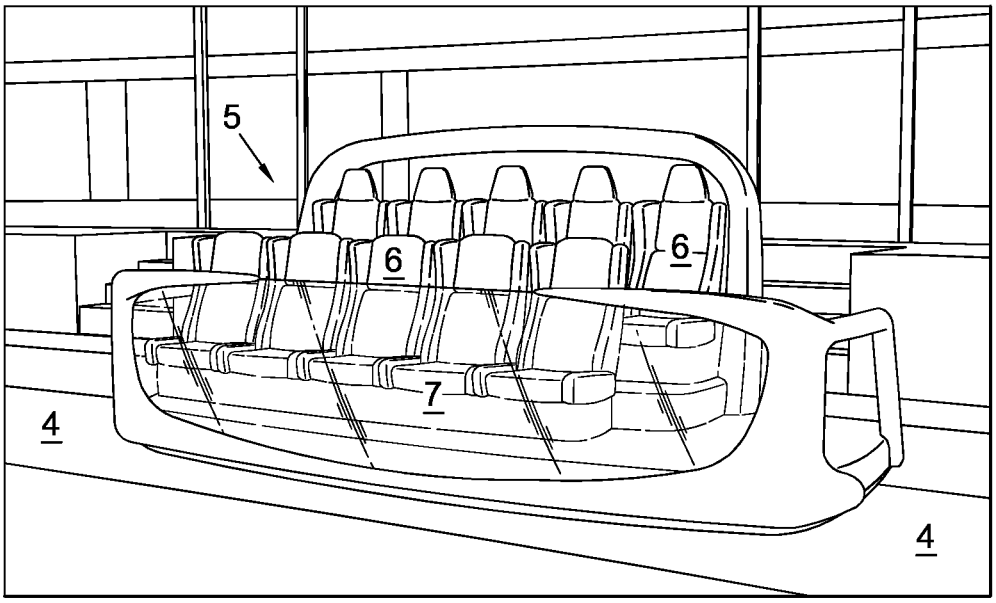
FIG. 3 is a perspective view of a pod for use in the dynamic spectator area according to an embodiment of the present invention.
Figure 4:
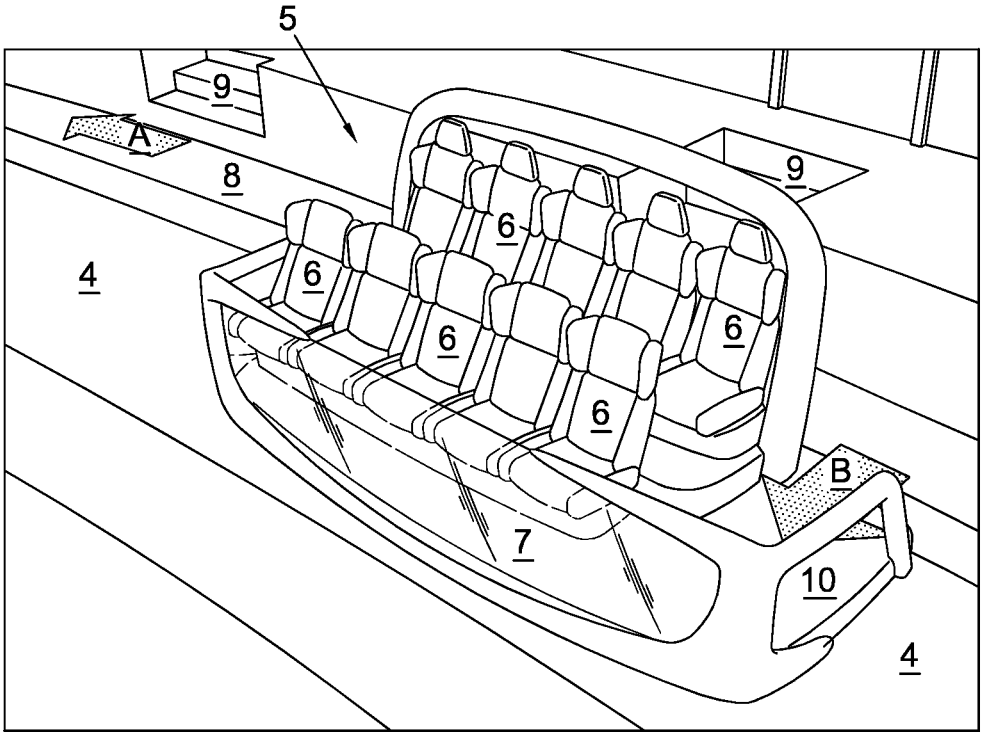
FIG. 4 is a further perspective view of the pod of FIG. 3 illustrating the entry pathway to the pod.
Figure 5:
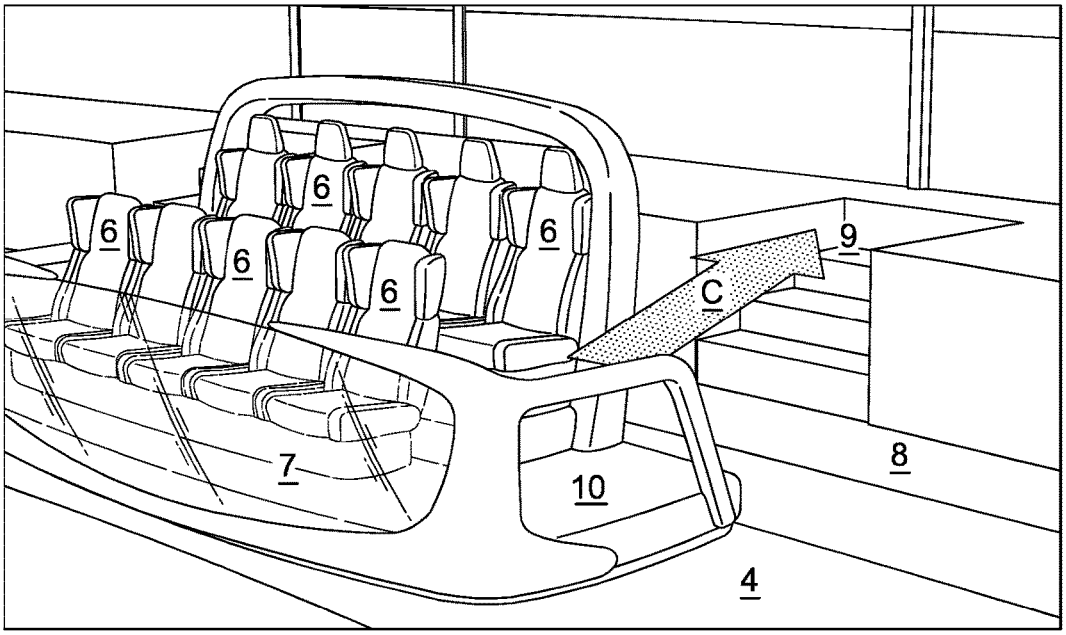
FIG. 5 is a further perspective view of the pod of FIG. 3 illustrating the exit pathway from the pod.

Referring now to FIGS. 3 to 5, each pod 5 comprises a plurality of seats 6, in this embodiment ten seats in two rows of five. The front row of seats 6 is lower than the rear row in order that the spectators seated in the rear row can see over the heads of those in the front row. The pod 5 has a front panel 7 which is in the form of an electronic advertising display for displaying advertising to the interior of the stadium.

Adjacent to the track substrate 4 and located radially outwards from it is an elevated platform 8. The platform 8 permits spectators to walk between the pods 5 or to exit the dynamic spectator area, as indicated by the arrow A. Spectator exits 9 are provided at intervals along the platform 8. A spectator boarding the pod 5 steps from the platform 8 onto a boarding platform 10 of the pod 5, as indicated by the arrow B. The boarding platform 10 is elevationally aligned with the platform 8. To exit the pod 5, the spectator steps from the boarding platform 10 onto the platform 8 and through one of the spectator exits 9, as indicated by the arrow C. During boarding or exit of the pod 5, the pod 5 maintains a constant speed.

Figure 6:
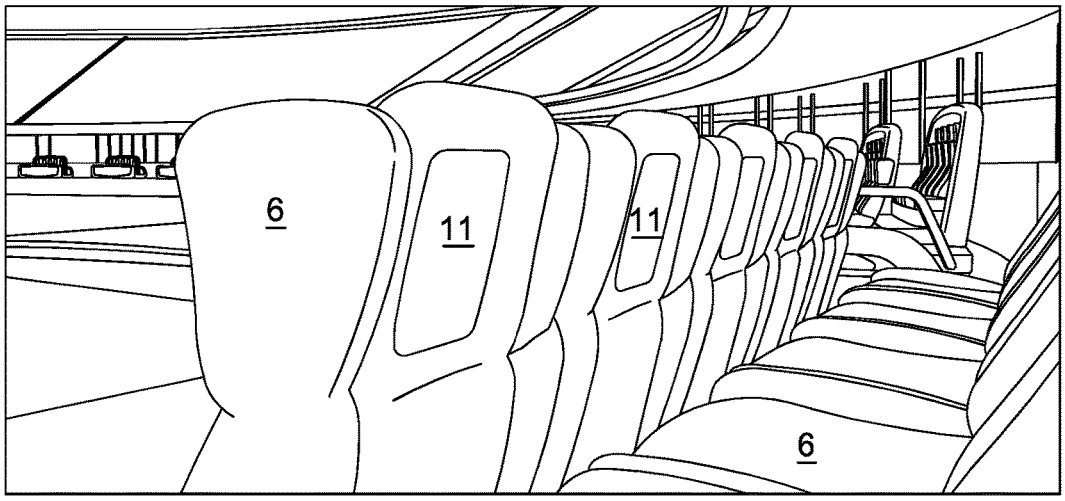
FIG. 6 is a detailed view of the pod of FIG. 3 illustrating the seatback video screens.
Figure 7:
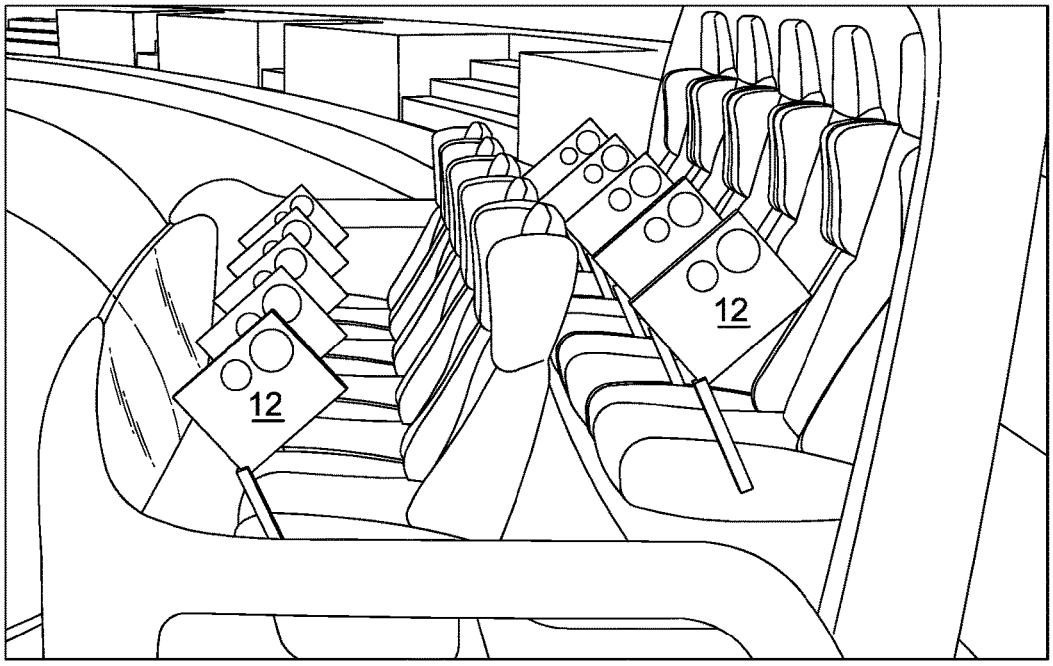
FIG. 7 is a detailed view of the pod of FIG. 3 illustrating the folding tables.
Figure 8:
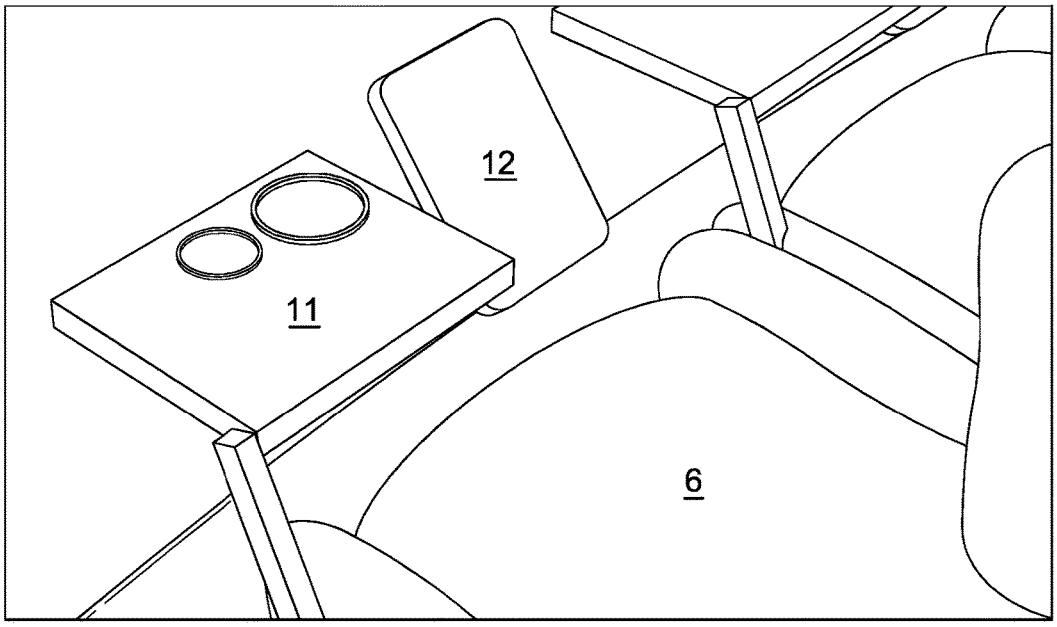
FIG. 8 is a detailed view of a folding table shown in FIG. 7 illustrating the stowable video screen.

As shown in FIG. 6, each of the seats 6 of the front row is provided with a video screen 11 for use by the spectators seated in the back row. As shown in FIGS. 7 and 8, folding tables 12 are provided for each seat to support drinks or snacks. The folding tables 12 of the front row include a stowable video screen 12 for use by the spectators of the front row.

In use, the pods 5 circulate around the stadium on the track 4, so that the spectators in the seats 6 have a 360 degree view of the sports field 1 over the period of one circuit of the track. The speed of the pods 5 is relatively low so that the spectators are able to board and leave at will in the same way as for fixed seating.

In summary, a dynamic spectator area for an audience at an entertainment venue comprises a plurality of seating pods 5 provided on a track substrate 4 which forms a continuous loop around the entertainment venue. The seating pods 5 are motorised for continuous movement along the track substrate 4 around the entertainment venue.

Throughout the description and claims of this specification, the words "comprise" and "contain" and variations of them mean "including but not limited to", and they are not intended to (and do not) exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments.

The invention claimed is:

1. An entertainment venue comprising a performance area and a spectator area surrounding the performance area, wherein the spectator area includes a static spectator portion and a dynamic spectator portion, the dynamic spectator portion including a track substrate defining a continuous loop around the performance area, a plurality of spectator pods adapted for movement around the loop relative to the track substrate; and a platform located adjacent to the track substrate, wherein each pod is spaced from and not physically connected to a neighbouring pod; and each pod includes at least one proximity sensor to sense the proximity of an adjacent pod, and a controller, the proximity sensor being connected to the controller, and the controller being adapted to maintain a predetermined minimum spacing between adjacent pods when the pods are in motion and/or detect a foreign object located between adjacent pods.

2. The entertainment venue according to claim 1, wherein each pod includes a drive train comprising a power source and a motor connected to the power source.

3. The entertainment venue according to claim 2, wherein each pod power source is a rechargeable power source.

4. The entertainment venue according to claim 2, wherein the motor is controlled by an output from the controller and the controller has a drive output wherein the motor drives the pod at a constant speed and an emergency output wherein the motor is stopped.

5. The entertainment venue according to claim 2, wherein the controller is adapted to maintain a predetermined minimum spacing between adjacent pods when the pods are in motion.

6. The entertainment venue according to claim 2, wherein the track substrate carries at least one rail in the form of a continuous loop or it defines a path along which the pods are adapted to move.

7. The entertainment venue according to claim 1, wherein the platform is elevationally higher than the track substrate.

8. The entertainment venue according to claim 1, wherein each pod includes an access opening, the access opening having a floor, the floor being elevationally aligned with the platform.

9. The entertainment venue according to claim 1, wherein each pod includes one or more seats located therein.

* * * * *